United States Patent [19]

Theriault et al.

[11] 4,250,585

[45] Feb. 17, 1981

[54] WATER SKIS HAVING A REINFORCED, FOAMED-IN-PLACE, PLASTIC HULL BONDED TO AN ALUMINUM DECK

[75] Inventors: Maurice N. Theriault, Renton, Wash.; Roger C. Teeter, Stacy; Francois Wirz, Roseville, both of Minn.

[73] Assignee: Hart Ski Mfg. Co., Inc., St. Paul, Minn.

[21] Appl. No.: 18,280

[22] Filed: Mar. 7, 1979

[51] Int. Cl.[3] ..... A63C 15/00

[52] U.S. Cl. ..... 9/310 A; 148/6.2; 264/46.7; 427/388.1

[58] Field of Search ..... 264/DIG. 83, 46.7, 45.5; 9/310 A, 310 E, 310 R, 6 P, 6 M; 148/6.2; 427/388 A

[56] References Cited

U.S. PATENT DOCUMENTS

| | | | |
|---|---|---|---|
| 2,811,471 | 10/1957 | Homeyer, Jr. | 148/6.2 |
| 3,042,545 | 7/1962 | Kienle et al. | 427/388 A X |
| 3,118,157 | 1/1964 | Houser | 9/310 A |
| 3,659,996 | 5/1972 | Schwarz et al. | 264/DIG. 83 |
| 3,749,594 | 7/1973 | Bibb | 9/6 P X |

FOREIGN PATENT DOCUMENTS

| | | | |
|---|---|---|---|
| 278566 | 5/1969 | Austria | 9/310 R |

*Primary Examiner*—Sherman D. Basinger

*Attorney, Agent, or Firm*—Merchant, Gould, Smith, Edell, Welter & Schmidt

[57] ABSTRACT

Water skis (1) are constructed with a reinforced, foamed-in-place, plastic hull (6) bonded to an aluminum deck (5 1). The foamed plastic hull (6) is reinforced, usually with a plurality of reinforcing elements (13–17). Preferably, the aluminum deck (5) is directly bonded to foamed plastic hull (6) without the use of any intermediate adhesives. Desirably, the lower surface of aluminum deck (5) is surface activated and primed before use.

6 Claims, 4 Drawing Figures

FIG. 1
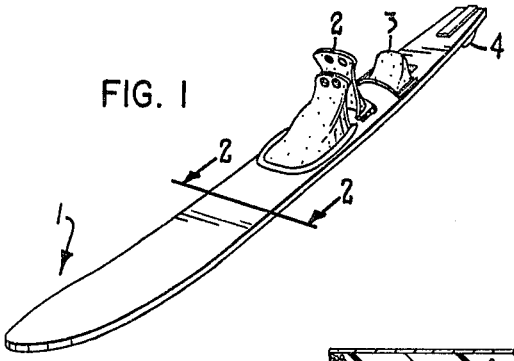
FIG. 2
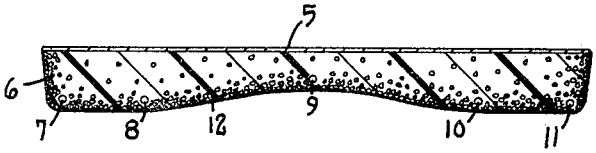
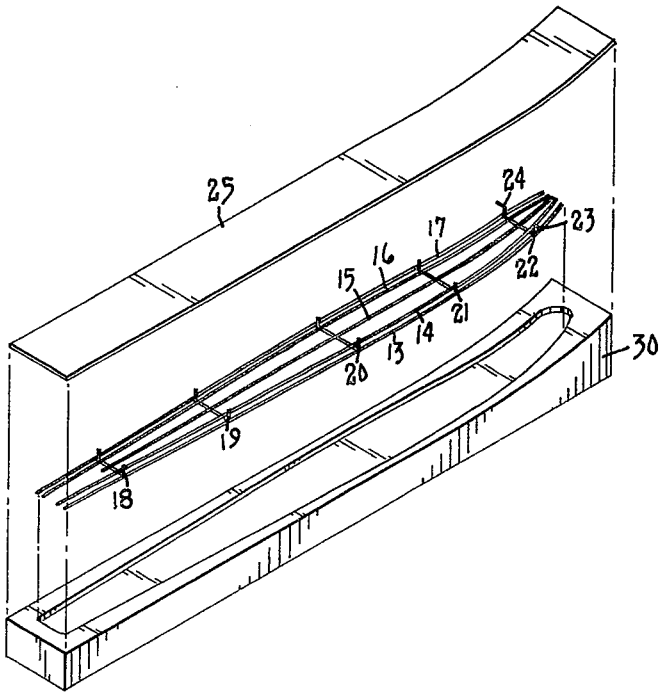
FIG. 3
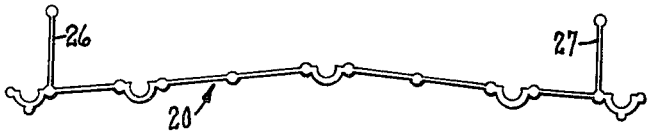
FIG. 4

WATER SKIS HAVING A REINFORCED, FOAMED-IN-PLACE, PLASTIC HULL BONDED TO AN ALUMINUM DECK

TECHNICAL FIELD

This invention relates to water skis which are manufactured by a process in which a reinforced plastic hull is bonded to an aluminum deck.

BACKGROUND OF PRIOR ART

Water skis have been made from a variety of materials including wood, plastic, metal, and various combinations of these materials.

In manufacturing water skis, water ski manufacturers seek to develop skis which have the right characteristics for the intended use (e.g. as recreational skis, as slalom skis, or as trick skis), have a minimum weight consistent with performance and stability requirements, are buoyant, are rugged, and the like. In addition, water ski manufacturers seek to achieve these properties using materials of construction and manufacturing techniques which lend themselves to mass production and minimum costs.

In the past, water skis have been produced from solid wood. More recently, water skis have been made as laminates or composites by gluing or molding together under pressure a plurality of wooden or plastic parts or a combination of such parts, frequently with the aid of such materials as glass reinforced polyester resins and epoxy resins. Sometimes, metal components are included for added strength.

As labor and energy costs change, and as different raw materials become more or less available, manufacturers continue their search for new ways of making water skis.

BRIEF SUMMARY OF THE INVENTION

The present invention is an improvement in the manufacture of water skis. The improved skis have a reinforced, foamed plastic hull which is bonded to an aluminum deck.

It has been discovered that an extremely strong, lightweight water ski can be made by using a method of construction in which a plastic foam (preferably a polyurethane foam), is formed in place so as to surround and encapsulate one or more reinforcing elements. Further, the plastic is foamed in place against an aluminum sheet which serves as an aluminum deck for the finished ski. During the formation and hardening of the foamed plastic, the foamed plastic is bonded to the aluminum sheet and is reinforced by the reinforcing elements. The ski is manufactured in such a way that the skin of the foamed plastic is allowed to remain intact to thereby serve as a tough, wear-resistant outer surface for the foamed plastic hull.

The aluminum used to form the aluminum deck in the water skis of the present invention has its underside or hull-engaging surface primed or coated so as to permit the foamed plastic to bond to the aluminum during manufacture.

The reinforcing elements generally extend the length of the ski and are located so as to avoid penetration of the outer skin or crust of the foamed plastic. Suitable reinforcing elements are small diameter metal rods.

BRIEF DESCRIPTION OF THE DRAWINGS

FIG. 1 is a perspective view of a water ski.

FIG. 2 is a cross-sectional view of the ski of FIG. 1 taken along lines 2—2 of FIG. 1.

FIG. 3 is an exploded perspective view showing the relative positions of a suitable mold, reinforcing elements with associated jigs, and the aluminum sheet.

FIG. 4 is a front view of one of the plastic jigs used to position the reinforcing elements within the mold.

DETAILED DESCRIPTION

General Description

The following description is made with reference to the drawings in which FIG. 1 illustrates a water ski, generally designated by the numeral 1. The ski which has been illustrated is equipped as a slalom ski and includes slalom ski bindings 2 and 3 and a rudder or fin 4.

A cross-sectional view of the ski is shown in FIG. 2. The details of construction of the ski as shown in FIG. 2 are as follows.

An aluminum deck 5 serves as the top surface of the ski. The use of aluminum is of considerable value for securing bindings 2 and 3 and fin 4 to the ski with screws. Immediately below and bonded to the aluminum deck 5 is a foamed plastic hull 6 of suitable cross-section. As shown in FIG. 2, the center portion of the bottom surface of hull 6 is concave to provide a longitudinally extending tunnel which enhances stability and maneuverability. Contained within the foamed plastic hull 6 are a plurality of reinforcing elements (e.g. steel rods) 7, 8, 9, 10 and 11 which generally extend from the toe or shovel of the ski to the heel or tail of the ski. It can be noted from FIG. 2 that the reinforcing elements 7–11 are positioned or spaced slightly above the lower surface 12 of the hull 6 so as to avoid any exposure of the reinforcing elements. However, the reinforcing elements are generally considerably closer to the lower surface 12 of the hull 6 than they are to the aluminum deck 5. This special relationship of the reinforcing elements relative to the aluminum deck allows the reinforcing elements to offset or balance the stresses imparted to the ski by the aluminum deck 5.

Materials of Construction

The water skis of the present invention have essentially three separate materials of construction.

The first element is the aluminum deck 5. The aluminum is used in sheet form which is often about 0.2–1.5 millimeters thick. For recreational and slalom skis, the aluminum deck will extend substantially the entire width of the ski and during manufacture it is common to use the aluminum in sheet form which is wider than the finished size of the ski for reasons which are later explained. However, for certain trick skis and other special skis, it may be desirable to have the aluminum deck 5 somewhat narrower than the maximum width of the ski and this may require using an inverted mold.

Regardless of the type of water ski that is being made, the lower surface of the aluminum deck 5 must be primed or coated with a suitable adhesive or the like so as to enable the foamed plastic to be bonded to the aluminum as the plastic is foamed and hardened. Although various adhesives can be used as is known in the art, best results are obtained if the surface of the aluminum is first activated and a special primer applied. The aluminum surface can be activated by an acid treatment of the aluminum in the following manner:

1. Vapor degrease the aluminum stock to remove any surface contamination.
2. Transfer the aluminum to a hot alkaline bath. This will remove surface contamination which was not dissolved by the vapor degreaser.
3. Remove the aluminum from the hot alkaline cleaner when the aluminum part is clean. Then allow excess alkaline solution to drain.
4. Rinse the aluminum with water to completely remove the alkaline solution.
5. Immerse the clean aluminum parts in a heated sodium dichromate/sulfuric acid solution. Immersion should be for a minimum of ten minutes while the solution is vigorously agitated to continually maintain fresh acid solution on the surface being etched. The typical acid solution will contain 30 parts distilled water, 10 parts sulfuric acid, and 1 part sodium dichromate.
6. Remove the aluminum parts from the acid solution when surface activation is complete and allow them to drain.
7. Rinse away all traces of the acid solution by spraying water over the aluminum parts to get a completely clean surface.
8. Quickly dry the aluminum parts in a forced air oven or tank. Note that the aluminum parts must not be handled after surface activation without the use of clean white gloves or the equivalent because direct contact with the skin will contaminate the cleaned surfaces by leaving an oily residue.
9. The aluminum parts should be primed immediately after cleaning and drying to prevent oxidation of the surface-activated aluminum and to avoid surface contamination. Priming should be completed within less than eight hours, preferably less than six hours, and desirably less than four hours after drying (e.g. within two hours). Unless special storage techniques are used, the surface activation of the aluminum tends to decrease to an unacceptable level in about 4–6 hours. A variety of primers can be used, but all primers do not serve with equal effectiveness. Suitable primers include those used for aluminum in the aircraft and aerospace industries. Epoxy/phenolic primers are preferred. The most preferred primer is a modified epoxy/phenolic primer manufactured by American Cyanamid Company and known as "BR-127 Corrosion Inhibiting Adhesive Primer".

The second class of materials of construction comprises the plastic foam-producing materials. Such chemicals are well known and need little description. Essentially, such ingredients include various chemicals which react together to form polyurethane foams, polyester foams, polystyrene foams, and the like. Of these various types of foam, polyurethane foam is preferred. As is known in the trade, such foam-producing chemicals are used in liquid form and injected into an appropriate mold (often accompanied by such auxiliary agents as catalysts, fillers such as glass beads, and blowing agents) and the ingredients react at room temperature or under conditions of elevated temperature and pressure to produce a foam. As the foam is formed and hardens, the foam will develop a dense, tough skin or crust. As contemplated by the present invention, the foamed plastic is formed to the final shape so that the crust or skin is not removed in any substantial way during the final finishing operations on the ski. This allows the crust or skin of the foamed plastic to serve as a tough, wear resistant surface. This is important since the internal portion of the foamed plastic tends to be less dense than the outer surface or skin and therefore is less wear resistant.

The third material of construction for the present invention is the reinforcing element. Some type of reinforcing element is essential to the manufacture of the present water skis since it has been found that if the reinforcing element is omitted, a ski made of only the aluminum deck 5 and foamed plastic hull 6 will droop or lose its desired shape very quickly. Further, it has been found that the reinforcing element must not be exposed through the outer surface of the foamed plastic hull 6. If the reinforcing elements are exposed in any significant way, the points of exposure become sites for deterioration to begin. Of course, the plastic hull 6 could be coated with some suitable material to hide or protect the reinforcing elements, but such a practice is undesirable for various reasons. Suitable reinforcing elements can be made of metal or strong plastics. Further, the reinforcing elements may take a variety of shapes ranging from wire mesh to corruguated strips to rods. However, all reinforcing elements do not serve with equal effectiveness. Metal rods, particularly small diameter steel rods (e.g. 1–6 millimeters in diameter) have been found to be extremely effective in providing the necessary stiffening or strengthening of the present skis without significantly adding to the weight and destroying buoyancy. Small diameter spring steel rods which have been cleaned immediately prior to use are particularly effective. Desirably, the skis will be reinforced with a plurality of these reinforcing elements (e.g. 3–7 reinforcing elements).

METHOD OF MANUFACTURE

Water skis produced according to the present invention are manufactured by combining all of the essential materials of construction in a suitable mold.

The method of construction can be more readily understood by reference to FIGS. 3 and 4.

To construct a water ski of the type described herein, a plurality of reinforcing rods 13–17 are prepositioned within a series of small plastic jigs 18–22, noting that the rods are prebent slightly so as to conform to the general shape of the cavity of mold 30. This assembly of reinforcing rods is then placed within the mold cavity. For convenience, one of the jigs 22 has been provided with two small tabs 23 and 24 which extend out of and adjacent to the mold cavity. Next, an aluminum sheet 25 is placed over the mole cavity, thereby closing it. Further, positioning the aluminum sheet 25 over the mold also serves to restrain tabs 23 and 24 to prevent movement of the jig within the mold during the later introduction of the foam-forming ingredients.

One of the jigs (20) is more fully shown in FIG. 4. As shown in FIG. 4, this plastic jig is designed to cradle five reinforcing rods in a pre-determined relationship. Further, the jig includes two upwardly directed legs 26 and 27 which assist in maintaining the desired spacing of the reinforcing rods relative to the aluminum sheet 25 during molding.

As an aside, it is noted that the center-most reinforcing rod 15 of FIG. 3 does not extend as far to the rear of the water ski as do the remaining reinforcing rods 13, 14, 16 and 17. This is because a slot is intended to be provided at the rear of the ski for later attachment of a suitable fin or rudder 4 as shown in FIG. 1.

Next, the reactive ingredients which form the foamed hull 6 can be introduced, usually through one or more inlets in the mold (not shown) and trapped air is allowed to escape through a suitable vent (also not shown).

The resulting assembly is restrained and the foamed plastic hull is formed, usually with the aid of heat and internally generated pressure. As previously noted, the foamed plastic is typically prepared from several reactive components (e.g. a polyisocyanate and a polyol) together with a suitable catalyst and blowing agent such as Freon and perhaps a pigment. Selection of suitable molding conditions of time, temperature and pressure is within the skill of the art. Once the ski has been formed and removed from the mold, the aluminum top surface or deck 25 is trimmed to the shape of the water ski, any excess resin is removed, and the ski cleaned and polished.

After fabrication, the aluminum deck 5 is suitably drilled to receive bindings 2 and additional bindings 3 or a rudder or fin 4 (if needed). Further, the upper or exposed surface of aluminum deck 5 can be suitably decorated, either before or after molding.

What is claimed is:

1. The process of manufacturing water skis which comprises the steps of:

(a) positioning small diameter steel rods, at least some of which extend substantially the length of the ski, within the cavity of a mold with plastic jigs which cause the rods to be spaced above the lower surface of the ski, said jigs becoming a part of the water ski;

(b) injecting a polyurethane foam into the mold against a prepositioned aluminum deck;

(c) allowing the polyurethane foam to harden in the mold while simultaneously bonding to the aluminum deck; and (d) removing from the mold a water ski blank which has a reinforced plastic hull bonded to said aluminum deck.

2. Processes of claim 1 in which at least one of said jigs is provided with restraining tabs to prevent significant movement of the reinforcing rods during injection and foaming of the plastic.

3. Processes of claim 1 or 2 in which:

(a) the aluminum deck is larger than the mold cavity, the aluminum deck serving to close the mold; and (b) after the water ski blank has been removed from the mold, the excess aluminum is trimmed to the desired water ski shape.

4. Processes of claim 3 in which the aluminum deck is generally rectangular in shape prior to said trimming.

5. The process of manufacturing water skis which consists essentially of:

(a) positioning from 3–7 small diameter spring steel rods within the cavity of a mold; said rods having been cleaned; said rods extending lengthwise in said mold and being held in a pre-determined relationship with a series of transverse plastic jigs which support the rods at a pre-determined height above the floor of the mold cavity;

(b) closing the mold with a rectangular sheet of aluminum, the lower surface of which has been surface activated with a dichromate/sulfuric acid bath and primed with an epoxy/phenolic primer;

(c) injecting polyurethane foam-producing ingredients into said mold to thereby form a foamed in place plastic hull which is bonded to the aluminum sheet;

(d) removing the aluminum/foamed plastic composite from the mold; and (e) trimming the aluminum to the desired water ski shape.

6. Processes of claim 5 in which at least one of said plastic jigs has tabs which extend laterally out over the edge of the mold cavity to permit the jig to be clamped in place between the aluminum sheet and the mold.

* * * * *